US005288016A

United States Patent [19]

Owen

[11] Patent Number: 5,288,016

[45] Date of Patent: Feb. 22, 1994

[54] RAIL-TIE FASTENING ASSEMBLY WITH ROCKING BEARING SEAT

[75] Inventor: S. Hudson Owen, Marshfield, Wis.

[73] Assignee: Kerr-McGee Chemical Corporation, Oklahoma City, Okla.

[21] Appl. No.: 997,020

[22] Filed: Dec. 28, 1992

[51] Int. Cl.[5] ..... E01B 2/00

[52] U.S. Cl. ..... 238/355; 238/264; 238/287; 238/310; 238/291; 238/DIG. 1

[58] Field of Search ..... 238/217, 264, 265, 275, 238/276, 287, 290, 291, 310, 338, 351, 355, 357, DIG. 1

[56] References Cited

U.S. PATENT DOCUMENTS

| | | | |
|---|---|---|---|
| 546,810 | 9/1895 | Emrich et al. | 238/291 |
| 571,064 | 11/1896 | Campbell | 238/291 |
| 1,022,790 | 4/1912 | Kupp | 238/265 |
| 1,045,730 | 11/1912 | Murray | 238/290 |
| 1,047,687 | 12/1912 | Myers | 238/290 |
| 1,054,553 | 2/1913 | Hoyt et al. | 238/290 |
| 1,069,756 | 8/1913 | Baston | 238/290 |
| 1,074,942 | 10/1913 | Gates | 238/290 |
| 2,140,917 | 12/1938 | Mahood | 238/338 |
| 4,874,128 | 11/1989 | Owen | 238/355 |
| 5,078,319 | 1/1992 | Owen | 238/355 |

*Primary Examiner*—Michael S. Huppert
*Assistant Examiner*—Scott L. Lowe
*Attorney, Agent, or Firm*—Herbert Hanegan

[57] ABSTRACT

A rail-tie fastening assembly for connecting a rail to a tie including a rail seat assembly and a rail anchor. The rail seat assembly is connectable to the tie and the rail seat assembly includes a seat hook assembly which extends over a portion of the rail flange. A portion of the rail seat assembly is formed on a first radius to provide a rail seat curved bearing surface. The rail anchor has an anchor hook assembly which extends over a portion of the rail flange. The rail anchor has a portion formed on a second radius to provide a rail anchor curved bearing surface. In the assembled position of the rail seat assembly and the rail anchor, the rail seat curved bearing surface engages the rail anchor curved bearing surface to form a rocking bearing seat.

9 Claims, 3 Drawing Sheets

RAIL-TIE FASTENING ASSEMBLY WITH ROCKING BEARING SEAT

FIELD OF THE INVENTION

The present invention relates to a rail-tie fastening assembly having a rail seat assembly and a rail anchor assembly where the rail seat assembly has a rail seat curved bearing surface and rail anchor has a rail anchor curved bearing surface which bearingly engages the rail seat curved bearing surface to form a rocking bearing seat in an assembled position of the rail seat assembly and the rail anchor assembly.

DESCRIPTION OF THE PREFERRED EMBODIMENTS

Figure 1:
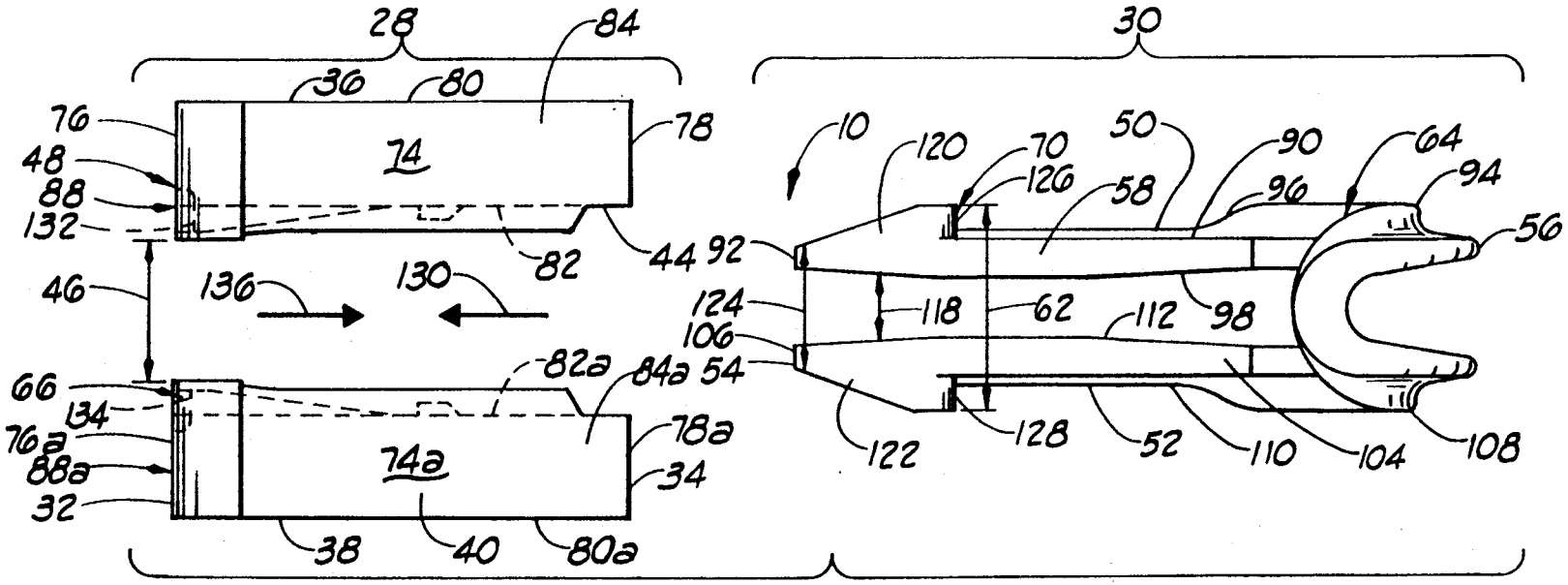
FIG. 1 is a top plan view of a rail-tie fastening assembly showing a rail seat assembly and a rail anchor in an unassembled position.
Figure 2:
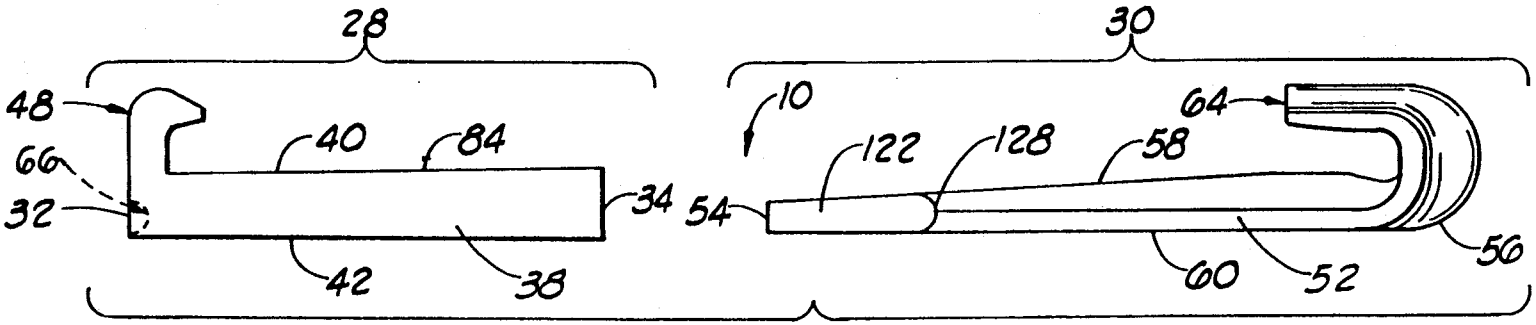
FIG. 2 is a side elevational view of the rail-tie fastening assembly of FIG. 1 showing the rail seat assembly and the rail anchor in the unassembled position.
Figure 3:
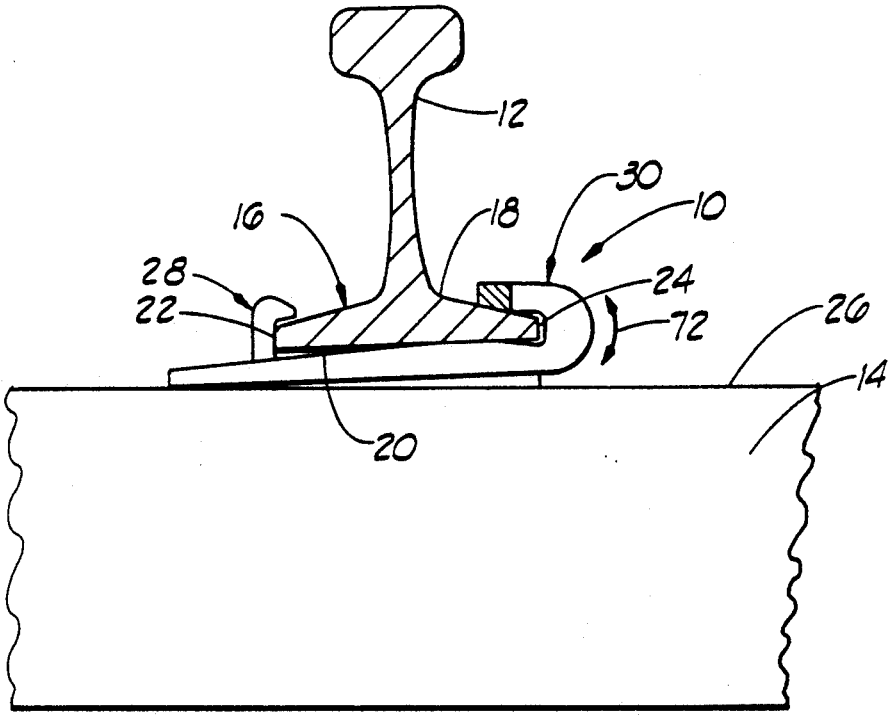
FIG. 3 is a side elevational view of the rail-tie fastening assembly of FIGS. 1 and 2 showing the rail seat assembly and the rail anchor assembly in an assembled position, and showing a cross sectional view of a rail and an elevational view of a portion of a tie.

As shown in FIGS. 1, 2 and 3, the present invention comprises a rail-tie fastening assembly 10 which is adapted to connect a rail 12 (FIG. 3) to a tie 14 (FIG. 3). As shown in FIG. 3, the rail 12 includes a rail flange 16 having an upper surface 18, a lower surface 20, a first side 22 and a second side 24. The tie 14 (FIG. 3) has an upper surface 26. Each rail-tie fastening assembly 10 includes a rail seat assembly 28 (FIGS. 1, 2 and 3) and a rail anchor 30 (FIGS. 1, 2 and 3).

The rail seat assembly 28 has a first end 32 (FIGS. 1 and 2), a second end 34 (FIGS. 1 and 2), a first side 36 (FIG. 1), a second side 38 (FIG. 1 and 2), an upper surface 40 (FIGS. 1 and 2) and a lower surface 42 (FIG. 2). An anchor slot 44 is formed through a portion of the rail seat assembly 28. The anchor slot 44 (FIG. 1) extends through a portion of the rail seat assembly 28 intersecting the first and the second ends 32 and 34 thereof. The anchor slot 44 has a predetermined slot width 46 (FIG. 1).

A seat hook assembly 48 (FIGS. 1 and 2) is formed on the rail seat assembly 28, generally near the first end 32 thereof. The seat hook assembly 48 is adapted to engage the first side 22 of the rail flange 16, as shown in FIG. 3.

As shown more clearly in FIG. 3, the rail seat assembly 28 is installed generally on the upper surface 26 of the tie 14 with the upper surface 40 of the rail seat assembly 28 being spaced a distance upwardly from the upper surface 26 of the tie 14.

The rail anchor 30 has a first side 50 (FIG. 1), a second side 52 (FIGS. 1 and 2), a first end 54 (FIGS. 1 and 2), a second end 56 (FIGS. 1 and 2), an upper surface 58 (FIGS. 1 and 2) and a lower surface 60 (FIG. 2). The rail anchor 30 is movable from a normal position to a moved position to be described below and movable from the moved position to the normal position. The rail anchor 30 has an anchor width 62 (FIG. 1) extending generally between the first and the second sides 50 and 52 of the rail anchor 30 in the normal position of the rail anchor 30. The anchor width 62 is greater than the slot width 46 in the normal position of the rail anchor 30. The anchor width 62 is less than the slot width 46 formed in the rail seat assembly 28 when the rail anchor 30 is moved to the moved position. An anchor hook assembly 64 (FIGS. 1 and 2) is formed on the second end 56 of the rail anchor 30. The anchor hook assembly 64 is adapted to extend a distance generally over a portion of the upper surface 18 of the rail flange 16, generally near the second side 24 of the rail flange 16.

The first end 54 of the rail anchor 30 is insertable through the anchor slot 44, generally at the second end 34 of the rail seat assembly 28 in the moved position of the rail anchor 30. The rail anchor 30 is movable through the anchor slot 44 to an assembled position. In the assembled position, the anchor hook assembly 64 extends generally over a portion of the upper surface 18 of the rail flange 16, generally near the second side 24 of the rail flange 16. The rail anchor 30 is movable from the moved position to the normal position in the assembled position of the rail anchor 30.

Figure 6:
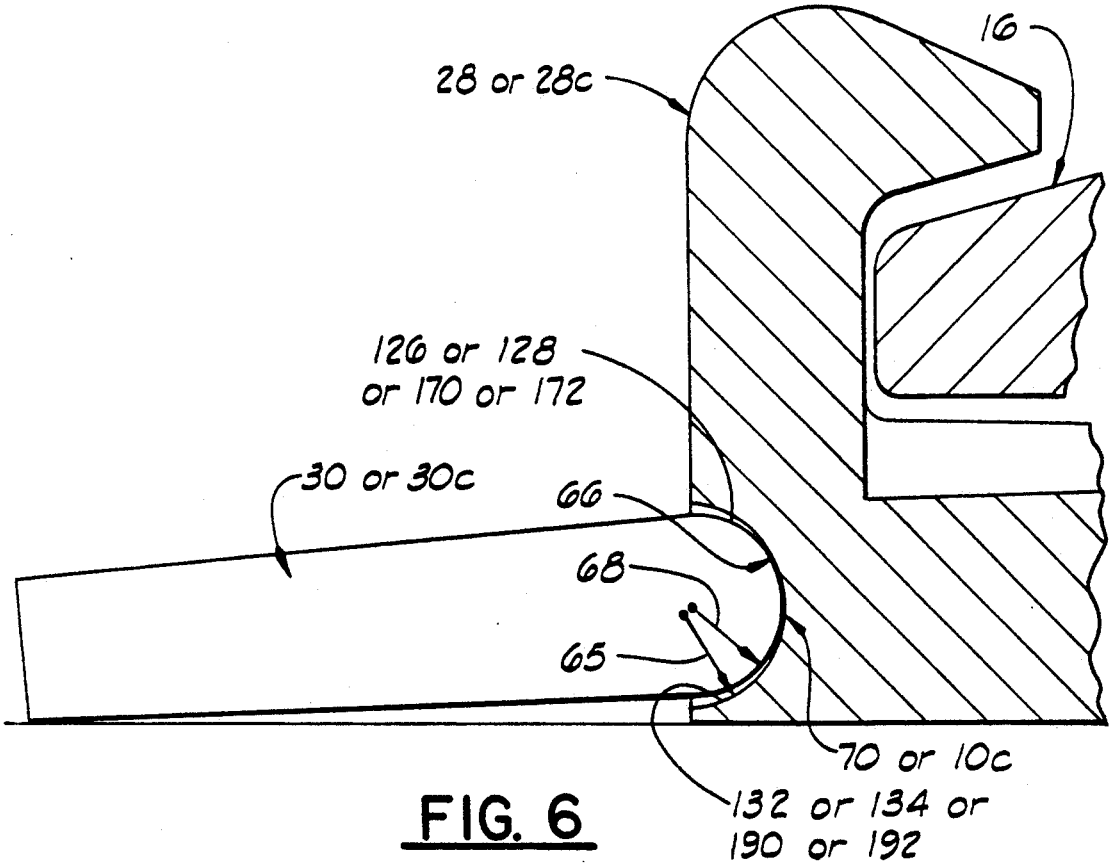
FIG. 6 is a partial elevational view of a rail anchor connected to a rail seat assembly showing a typical rail seat curved bearing surface and a typical rail anchor curved bearing surface and showing in cross section a portion of a rail flange.

A portion of the rail seat assembly 28 is formed on a first radius 65 (FIG. 6) to provide a rail seat curved bearing surface 66 (FIGS. 1 and 6). A portion of the rail anchor 30 is formed on a second radius 68 (FIG. 6) to provide a rail anchor curved bearing surface 70 (FIGS. 1 and 6). In the assembled position of the rail seat assembly 28 and the rail anchor 30 and in the normal position of the rail anchor 30, the rail anchor curved bearing surface 70 engages the rail seat curved bearing surface 68, as shown in FIG. 6. The first radius 65 is sufficiently larger than the second radius 68 so that, when the rail anchor 30 and the rail seat assembly 28 are in the assembled position connected to a rail 12, the rail anchor curved bearing surface 70 rocks or rolls on the rail seat curved bearing surface 66 thereby providing a rocking bearing seat as the rail anchor 30 is moved in an upwardly or downwardly direction 72 (FIG. 3) for reducing frictional engagement between the rail anchor 30 and the rail seat assembly 28.

As shown in FIG. 1, the rail seat assembly 28 includes a first rail seat plate 74 having a first end 76, a second end 78, a first side 80, a second side 82, an upper surface 84 and a lower surface coplanar with the lower surface 42. A first seat hook 88 is formed on the first end 76 of the rail seat plate 74. The first seat hook 88 is shaped and adapted to engage a portion of the first side 22 of the rail flange 16. A portion of the first seat hook 88 is shaped and adapted to extend generally over a portion of the upper surface 18 of the rail flange 16, generally near the first side 22 of the rail flange 16. The first seat hook 88 extends generally over a portion of the upper surface 18 of the rail flange 16 and is spaced a distance from the upper surface 18 of the rail flange 16.

As shown in FIG. 1, the rail seat assembly 28 also includes a second rail seat plate 74a which is constructed and operates exactly like the first rail seat plate 74 described before. The various components of the rail seat plate 74a are designated in the drawings with the same reference numerals like components of the rail seat plate 74, except the various components of the rail seat plate 74a also include the additional letter designation "a".

As shown in FIG. 1, the rail anchor 30 includes a first tine 90 having a first end 92 and a second end 94. The first tine 90 also has a first side 96, a second side 98, an upper surface coplanar with the upper surface 58 and a lower surface coplanar with the lower surface 60. The rail anchor 30 also includes a second tine 104 having a first end 106, a second end 108, a first side 110, a second side 112, an upper surface coplanar with the upper surface 58, a lower surface coplanar with the lower surface 60. The second ends 94 and 108 of the respective first and second tines 90 and 104 are connected together so that the tines 90 and 104 extend in generally parallel extending planes with the second side 98 of the first tine 90 generally facing and being spaced a distance from the second side 112 of the second tine 104. The distance between the first side 96 of the first tine 90 and the first side 110 of the second tine 104 about forms the anchor width 62.

The anchor hook assembly 64 includes one portion which connects the second end 94 of the first tine 90 to the second end 108 of the second tine 104. The anchor hook assembly 64 and the first and the second tines 90 and 104 are integrally constructed.

A tapered portion 120 (FIG. 1) is formed on the first tine 90 generally near and intersecting the first end 94. The tapered portion 120 (FIGS. 1 and 2) extends a distance from the first end 92 of the first tine 90 toward the second end 94 of the first tine 90. A tapered portion 122 is formed on the first side 112 of the second tine 104, generally near and intersecting the first end 106 of the second tine 104. The tapered portion 122 extends a distance generally along the first side 110 generally from the first end 106 toward the second end 108. The tapered portions 120 and 122 cooperate to provide a first end width 124 (FIG. 1) of the rail anchor 30 which is less than the anchor width 62 and less than the slot width 46 of the anchor slot 44. Thus, the first end portion of the rail anchor 30 has the first end width 124 sized so that the first end portion of the rail anchor 30 is insertable a distance into the anchor slot 44 to facilitate the insertion of the rail anchor 30 into the anchor slot 44.

A seat surface 126 (FIGS. 1 and 6) is formed on the first side 98 of the first tine 90 generally near the beginning of the tapered portion 120. The seat surface 126 is spaced a distance from the first end 92 of the first tine 90.

A seat surface 128 (FIGS. 1, 2 and 6) is formed on the first side 110 of the second tine 104. The seat surface 128 is spaced a distance from the first end 106 of the second tine 104.

The seat surfaces 126 and 128 each are formed on the second radius 68 and the seat surfaces 126 and 128 cooperate to provide a pair of rail anchor curved bearing surfaces comprising the rail anchor curved bearing surface 70.

In operation, the rail seat assembly 28 is connected to the upper surface 18 of the tie 14. The rail seat assembly 28 may include an anchor which is disposed in a cavity formed in the upper surface 26 of the tie 14 or the rail seat assembly 28 may be secured to the upper surface 26 of the tie 14 in any other manner such as by adhesively connecting the rail seat assembly 28 to the upper surface 26. The connection of the rail seat assembly 28 to the tie 14 is described in detail in U.S. Pat. No. 4,874,128, issued Oct. 17, 1989, entitled, "Rail-Tie Fastening Assembly", and in U.S. Pat. No. 5,078,319, issued Jan. 7, 1992, entitled, "Rail-Tie Fastening System", both assigned to the assignee of the present invention, which disclosures specifically hereby are incorporated herein by reference.

The rail anchor 30 is then positioned so that the first end 32 of the rail anchor 30 is disposed generally adjacent the anchor slot 44 with a portion of the first end portion 124 of the rail anchor 30 being disposed generally within a portion of the anchor slot 44 generally adjacent the second end 56 of the rail seat assembly 28.

In this position, the operator drives the rail anchor 30 in an insertion direction 130 (FIG. 1) generally from the second end 34 toward the first end 32 of the rail seat assembly 28 into the anchor slot 44. As the operator drives the rail anchor 30 in the insertion direction 130, the tapered portions 120 and 122 engage the second sides 82 and 82a of the rail seat plates 74 and 74a thereby forcing the first ends 92 and 106 of the respective first and second tines 90 and 94 generally toward each other. The operator continues to drive the rail anchor 30 in the insertion direction 130 until the tapered portions 120 and 122 have been disposed entirely within the anchor slot 44 thereby resulting in the second sides 98 and 112 of the respective first and second tines 90 and 104 being moved generally toward each other to a position wherein the rail anchor 30 has been moved to the moved position and the anchor width 62 has been reduced to about the same size as the slot width 46.

In the moved position of the rail anchor 30, the operator continues to force or drive the rail anchor 30 in the insertion direction 130 thereby moving the rail anchor 30 further through the anchor slot 44 until the seat surfaces 126 and 128 (rail anchor curved bearing surfaces) are moved slightly beyond the first end 32 of the rail seat assembly 28. The seat surfaces 126 and 128 form a reduced width portion of the rail anchor 30 thereby permitting the second sides 98 and 112 to be moved apart to a position wherein the first and the second tines 90 and 104 return to the normal position where the rail anchor 30 has been moved to the assembled within the rail seat assembly. In the normal position, the seat surface 126 (rail anchor curved bearing surface) on the first tine 90 is in the normal position wherein the seat surface 128 (rail anchor curved bearing surface) engages a portion of the first end 32 of the rail seat plate 80 and the seat surface 128 (rail anchor curved bearing surfaces) on the second tine 104 is in the normal position wherein the seat surface 128 (rail anchor curved bearing surface) engages a portion of the first end 76a of the rail seat plate 80a.

More particularly, the rail seat curved bearing surface 66 comprises a seat surface 132 (FIGS. 1 and 6) formed on the first end 76 of the rail seat plate 74 and a seat surface 134 (FIGS. 1 and 6) formed on the first end 76a of the second rail seat plate 74a. The seat surface 126 engages the seat surface 132 and the seat surface 128 engages the seat surface 134 to prevent the rail anchor 30 from being moved in a removal direction 136 (FIG. 1) thereby securing the rail anchor 30 in the assembled position and in the normal position connected to the rail seat assembly 38. Each of the seat surfaces 132 and 134 on the first and the second rail seat plates 74 and 74a are formed on the first radius 65.

To remove the rail anchor 30, the first and the second tines 90 and 104 are moved in a direction generally toward each other to the moved position. In this moved position, the rail anchor 30 is moved in the removal direction 136 to remove the rail anchor 30 from the anchor slot 44.

Figure 4:
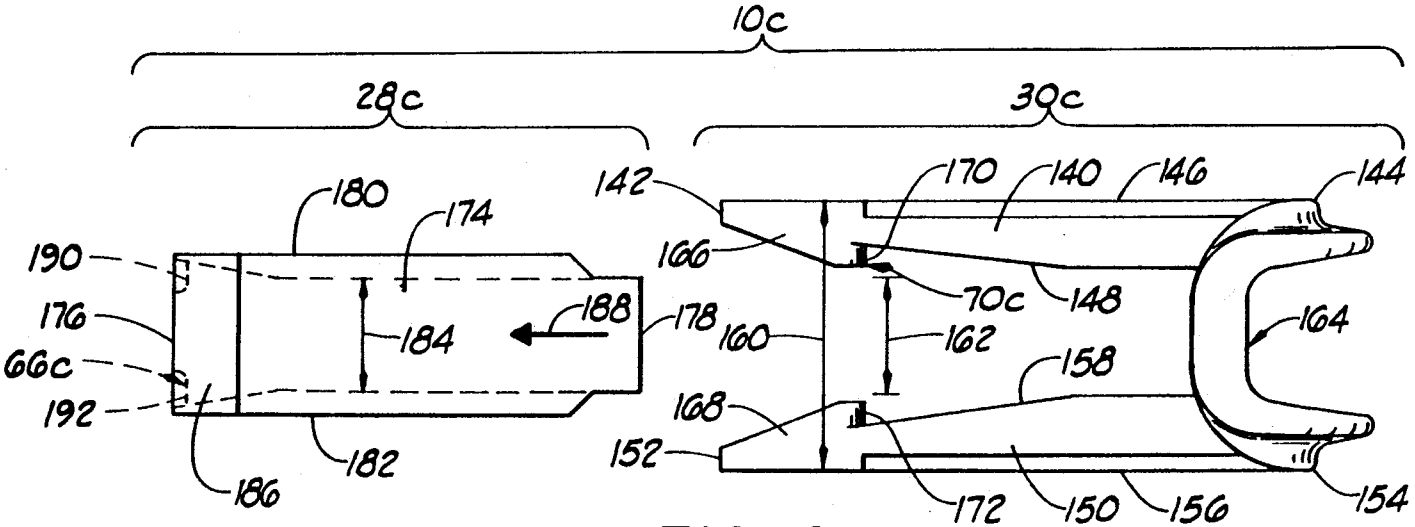
FIG. 4 is a top plan view of a modified rail-tie fastening assembly showing a modified rail seat assembly and a modified rail anchor assembly in an unassembled position.
Figure 5:
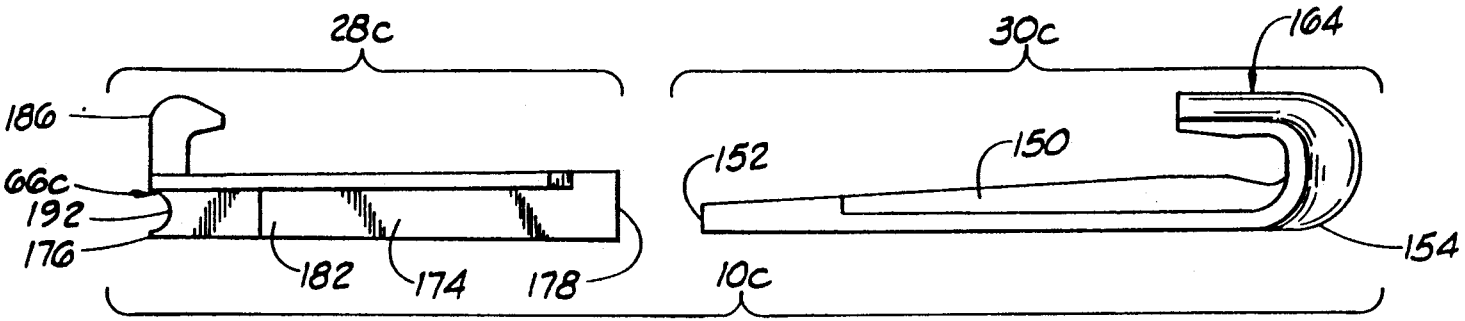
FIG. 5 is a side elevational view of the rail-tie fastening assembly of FIG. 4 showing the rail seat assembly and the rail anchor assembly in the unassembled position.

Shown in FIGS. 4 and 5 is a modified rail-tie fastening assembly 10c which includes a modified rail seat assembly 28c and a modified rail anchor 30c.

As shown in FIG. 4, the rail anchor 30c has a first tine 140 having a first end 142, a second end 144, a first side 146 and a second side 148. The rail anchor 30c also includes a second tine 150 (FIGS. 4 and 5) having a first end 152, a second end 154, a first side 156, a second side 158. The second ends 144 and 154 are connected together and the tines 140 and 150 extend in generally parallel planes.

The first side 146 of the first tine 140 generally faces away from and is spaced a distance 160 (FIG. 4) from the first side 156 of the second tine 150. The distance between the second side 148 of the first tine 140 and the second side 158 of the second tine 150 forms an anchor width 162 (FIG. 4).

An anchor hook assembly 164 is connected to the second ends 144 and 154 of the respective first and second tines 140 and 150. In this embodiment, the tines 140 and 150 and the anchor hook assembly 164 are integrally constructed from a single unitary piece of metallic material.

A tapered portion 166 is formed on the first side 146 of the first tine 140 generally near and intersecting the first end 142 thereof. A tapered portion 168 is formed on the first side 156 of the second tine 150, generally near and intersecting the first end 152 of the second tine 150.

The rail anchor 30c includes a modified rail anchor curved bearing surface 70c (FIGS. 4 and 6). The rail anchor curved bearing surface 70c comprises a seat surface (rail anchor curved bearing surface) 170 (FIGS. 4 and 6) formed on the first side 146 of the first tine 140 generally near the beginning of the tapered portion 166. The rail anchor curved bearing surface 70c also comprises a seat surface 172 (FIGS. 4 and 6) formed on the first side 156 of the second tine 150, generally near the beginning of the tapered portion 168. The seat surfaces 170 and 172 (rail anchor curved bearing surfaces) cooperate to secure the rail anchor 30c within the rail seat assembly 28c. The seat surface 170 and 172 (rail anchor curved bearing surfaces) each are formed on the first radius 65.

As shown in FIGS. 4 and 5, the rail seat assembly 28c comprises a rail seat plate 174. The rail seat plate 174 has a first end 176, a second end 178, a first side 180 and a second side 182. The rail seat plate 174 has a width 184 which forms an anchor slot. A seat hook 186 is formed on the first end 176 of the rail seat plate 174.

The rail seat plate 174 is connected to the upper surface 26 of the tie 14 either by disposing an anchor portion (not shown) of the rail seat plate 174 within a cavity formed in the upper surface 26 of the tie 14 or by connecting the rail seat plate 174 to the upper surface 26 of the tie 14 by way of an adhesive or other connection means. The construction and operation of a rail seat plate constructed like described before with respect to the rail seat plate 174 except not including a rail seat curved bearing surface 66c and its connection to a tie is described in detail in U.S. Pat. No. 5,078,319, referred to before.

In operation, the rail anchor 30c is positioned so that the first ends 142 and 152 of the tines 140 and 150 are disposed generally adjacent the anchor slot formed by the width 184 between the opposite sides 180 and 182 of the rail seat plate 174.

In this position, the operator drives the rail anchor 30c in an insertion direction 188 (FIG. 4). As the operator drives the rail anchor 30c in the insertion direction 188, the tapered portion 166 and 168 engage the first and the second sides 180 and 182 thereby forcing the first ends 142 and 150 generally away from each other since the anchor width 162 is less than the width 184 of the rail seat plate 174. In this expanded or moved position of the rail anchor 30c, the operator continues to force or drive the rail anchor 30c in the insertion direction 188 until the rail anchor curved bearing surface 70c is moved slightly beyond the first end 176 of the rail seat plate 174. In this position, the tines 140 and 150 are moved back to a normal position. In the normal position, the rail anchor curved bearing surface 70c engages the rail seat curved bearing surface 66c thereby securing the rail anchor 30c in the assembled position and in the normal position connected to the rail seat assembly 28c.

The rail anchor curved bearing surface 66c more particularly comprises a pair of seat surfaces 190 (FIGS. 4 and 6) and 192 (FIGS. 4, 5 and 6) formed on the first end 176 of the rail seat plate 174 with the seat surface 190 being generally adjacent the first side 180 and the seat surface 192 being generally adjacent the second side 182 of the rail seat plate 174. The seat surfaces 190 and 192 (rail seat curved bearing surfaces) each are formed on the second radius 68. Thus, in the assembled position of the rail anchor 30c and the rail seat plate 174, the seat surface 170 engages the seat surface 190 and the seat surface 172 engages the seat surface 192.

Changes may be made in the construction and the operation of the various components, elements and assemblies described herein without departing from the spirit and the scope of the invention as defined in the following claims.

What is claimed is:

1. A rail-tie fastening assembly for connecting a rail flange with an upper surface, a lower surface, a first side and a second side to a tie having an upper surface, comprising:

a rail seat assembly connectable to the upper surface of the tie having a seat hook assembly formed on a portion of the rail seat assembly and being adapted to extend a distance generally over a portion of the upper surface of the rail flange generally near the first side of the rail flange, a portion of the rail seat assembly being formed on a first radius to provide a rail seat curved bearing surface; and a rail anchor, the rail anchor being operatively associated with the rail seat assembly, an anchor hook assembly being formed on a portion of the rail anchor with a portion of the rail anchor hook assembly being adapted to extend over a portion of the upper surface of the rail flange generally near the second side of the rail flange, a portion of the rail anchor being formed on a second radius to provide a rail anchor curved bearing surface, the rail anchor curved bearing surface being disposed adjacent the rail seat curved bearing surface in an assembled position of the rail anchor and the rail seat assembly, the first radius being larger than the second radius and the rail anchor curved bearing surface rocking or rolling on the rail seat curved bearing surface for reducing friction therebetween.

2. The rail-tie fastening assembly of claim 1 wherein the rail anchor is defined further as being movable from a normal, unstressed position to a moved, stressed position, the rail anchor being movable from the normal, unstressed position to the moved position and then stressed with respect to the rail seat assembly to the assembled position of the rail anchor and the rail seat assembly with the rail anchor resuming the normal, unstressed position while in the assembled position of the rail anchor and the rail seat assembly, the rail anchor assembly being movable to the moved, stressed position and then movable with respect to the rail seat assembly for removing the rail anchor from the rail seat assembly.

3. The rail-tie fastening assembly of claim 2 wherein the rail seat assembly is defined further as having a first end, a second end, an upper surface and a lower surface, the seat hook assembly being formed on the rail seat assembly generally near the first end of the rail seat assembly, and the rail seat curved bearing surface being formed on the first end of the rail seat assembly, and wherein the rail anchor is defined further as having an upper surface, a lower surface, a first side, a second side, a first end and a second end, the anchor hook assembly being formed on the rail anchor near the second end of the rail anchor, the rail anchor curved bearing surface being formed on the rail anchor near the first end of the rail anchor.

4. The rail-tie fastening assembly of claim 3 wherein the rail anchor further comprises:

a first tine having a first end, a second end, a first side, a second side, an upper surface and a lower surface;

a second time having a first end, a second end, a first side, a second side, an upper surface and a lower surface; and means for connecting the second end of the first tine to the second end of the second tine with the first and the second tines extending in substantially parallel planes, the upper surface of the first tine being in a substantially coplanar position with respect to the upper surface of the second tine and the lower surface of the first tine being in a substantially coplanar disposition with the lower surface of the second tine, the first side of the first tine being spaced a distance from the first side of the second tine, the first ends of the first and the second tines cooperating to form the first end of the rail anchor and the second ends of the first and the second tines cooperating to form the second end of the rail anchor and the upper surface of the first and the second tines cooperating to form the upper surface of the rail anchor and the lower surfaces of the first and second tines cooperating to form the lower surface of the rail anchor, the first side of the first tine forming the first side of the rail anchor and the first side of the second tine forming the second side of the rail anchor, the anchor width being the distance between the first side of the first tine and the first side of the second tine, the first tine being movable generally away from the second tine to move the rail anchor to the moved, stressed position and the first tine being movable generally toward the second tine to move the rail anchor to the normal, unstressed position, a first rail anchor curve bearing surface being formed on a portion of the first tine and a second rail anchor curve bearing surface being formed on a portion of the second tine, the first and second rail anchor curved bearing surfaces on the first and second tines cooperating to form the rail anchor curved bearing surface of the rail anchor assembly; and wherein the rail seat assembly is defined further as having a first side and a second side, a first rail seat curved bearing surface being formed on the first end of the rail seat assembly intersecting a portion of the first side of the rail seat assembly with the first rail seat curved bearing surface near the first side of the rail seat assembly being engageable with the first rail anchor curved bearing surface on the first tine in the assembled position of the rail anchor and the rail seat assembly, and a second rail seat curved bearing surface being formed on the first end of the rail seat assembly generally near and intersecting the second side of the rail seat assembly, the second rail curved bearing surface near the second side of the rail seat assembly being engageable with the second rail anchor curved bearing surface on the second tine in the assembled position of the rail anchor and the rail seat assembly, the first and second rail anchor curved bearing surfaces cooperating to form the rail anchor curved bearing surface of the rail seat assembly and each of the first and second rail anchor curved bearing surfaces being formed on the first radius.

5. The rail-tie fastening assembly of claim 3 wherein the rail anchor is defined further to comprise:

a first tine having a first end, a second end, a first side, a second side, an upper surface and a lower surface;

a second tine having a first end, a second end, a first side, a second side, an upper surface and a lower surface; and means for connecting the second end of the first tine to the second end of the second tine, the second side of the first tine being spaced a distance from the second side of the second tine, the first ends of the first and the second tines cooperating to form the first end of the rail anchor and the second ends of the first and the second tines cooperating to form the second end of the rail anchor and the upper surfaces of the first and the second tines cooperating to form the upper surface of the rail anchor and the lower surfaces of the first and the second tines cooperating to form the lower surface of the rail anchor, the first side of the first tine forming the first side of the rail anchor and the first side of the second tine forming the second side of the rail anchor, an anchor width being the distance between the first side of the first tine and the first side of the second tine, the first tine being movable generally toward the second tine to move the rail anchor to the moved, stressed position and the first tine being movable generally away from the second tine to move the rail anchor to the normal, unstressed position; and wherein the rail seat assembly comprises further a first side and a second side, an anchor slot being formed through the rail seat assembly between the first side and the second side of the rail seat assembly and the slot having a slot width, the slot width being less than the anchor width.

6. The rail-tie fastening assembly of claim 5 wherein the first tine is defined further as having a tapered portion formed on the first side of the first tine generally near and intersecting the first end of the first tine, and wherein the second tine is defined further as having a tapered portion formed on the first side of the second tine generally near and intersecting the first end of the second tine, the tapered portions on the first and the second tines cooperating to provide a first end width less than the slot width and less than the anchor width in the normal, unstressed position of the rail anchor, the tapered portions of the first and the second tines being insertable into the anchor slot generally at the second end of the rail seat assembly and the rail anchor being moved to the moved, stressed position as the tapered portions upon the first and the second tines are moved into the anchor slot.

7. The rail-tie fastening assembly of claim 5 wherein the rail anchor curved bearing surface further comprises a first rail anchor curved bearing surface formed on the first side of the first tine and a second rail anchor curved bearing surface formed on the first side of the second tine, and wherein the rail seat assembly further comprises:

a first seat plate having an upper surface, a lower surface, a first end, a second end, a first side and a second side, a first seat hook being formed on the first end of the first seat plate and the first seat hook being an extended distance over a portion of the upper surface of the rail flange and the first seat hook forming a portion of the seat hook assembly, a first rail seat curved bearing surface being formed on the first end of the first seat plate generally near and intersecting the second side of the first seat plate and the first rail seat curved bearing surface on the first seat plate forming a portion of the rail seat curved bearing surface of the rail seat assembly; and a second seat plate having an upper surface, a lower surface, a first end, a second end, a first side and a second side, a second seat hook being formed on the first end of the second seat plate and the second seat hook being an extended distance generally over a portion of the upper surface of the rail flange and the second seat hook forming a portion of the seat hook assembly of the rail seat assembly, a second rail seat curved bearing surface being formed on the first end of the second seat plate generally near and intersecting a portion of the second side of the second rail seat plate with the second rail seat curved bearing surface forming a portion of the rail seat curved bearing surface of the rail seat assembly, the first rail anchor curved bearing surface on the first tine being engageable with the first rail seat curved bearing surface on the first seat plate and the second rail anchor curved bearing surface on the second tine being engageable with the second rail seat curved bearing surface on the second seat plate in the assembled position of the rail anchor and the rail seat assembly, the second side of the second seat plate being spaced a distance from the second side of the first seat plate and a space between the second sides of the first and the second seat plates forming the anchor slot, the first ends of the first and the second seat plates cooperating to form the first end of the rail seat assembly and the second ends of the first and the second seat plates cooperating to form the second end of the rail seat assembly and the upper surfaces of the first and the second seat plates cooperating to form the upper surface of the rail seat assembly and the lower surfaces of the first and the second plates cooperating to form the lower surface of the rail seat assembly, the first side of the first seat plate forming the first side of the rail seat assembly and the first side of the second seat plate forming the second side of the rail seat assembly.

8. A rail-tie fastening assembly for connecting a rail flange with an upper surface, a lower surface, a first side and a second side to a tie having an upper surface, comprising:

a rail seat assembly connectable to the upper surface of the tie having a seat hook assembly formed on a portion of the rail seat assembly and being adapted to extend a distance generally over a portion of the upper surface of the rail flange generally near the first side of the rail flange, a portion of the rail seat assembly being formed on a first radius to provide a rail seat curved bearing surface; and a rail anchor, the rail anchor being operatively associated with the rail seat assembly, an anchor hook assembly being formed on a portion of the rail anchor with a portion of the anchor hook assembly being adapted to extend over a portion of the upper surface of the rail flange generally near the second side of the rail flange, a portion of the rail anchor being formed on a second radius to provide a rail anchor curved bearing surface, the rail anchor curved bearing surface being disposed adjacent the rail seat curved bearing surface in an assembled position of the rail anchor and the rail seat assembly, the first radius being larger than the second radius and the rail anchor curved bearing surface rocking or rolling on the rail seat curved bearing surface for reducing friction therebetween;

a first seat plate having an upper surface, a lower surface, a first end, a second end, a first side and a second side, a first seat hook being formed on the first end of the first seat plate and the first seat hook being an extended distance over a portion of the upper surface of the rail flange and the first seat hook forming a portion of the seat hook assembly, a first rail seat curved bearing surface being formed on the first end of the first seat plate generally near and intersecting the second side of the first seat plate and the first rail seat curved bearing surface on the first seat plate forming a portion of the rail seat curved bearing surface of the rail seat assembly; and a second seat plate having an upper surface, a lower surface, a first end, a second end, a first side and a second side, a second seat hook being formed on the first end of the second seat plate and the second seat hook being an extended distance generally over a portion of the upper surface of the rail flange and the second seat hook forming a portion of the seat hook assembly of the rail seat assembly, a second rail seat curved bearing surface being formed on the first end of the second seat plate generally near and intersecting a portion of the second side of the second rail seat plate with the second rail seat curved bearing surface forming a portion of the rail seat curved bearing surface of the rail seat assembly, the first side of the first seat plate being spaced a distance from the first side of the second seat plate defining an anchor slot having a slot width; and the rail anchor further comprising:

a first tine having a first end, a second end, a first side, a second side, an upper surface and a lower surface;

a second tine having a first end, a second end, a first side, a second side, an upper surface and a lower surface; and means for connecting the second end of the first tine to the second end of the second tine, the second side of the first tine being spaced a distance from the second side of the second tine defining an anchor width with the anchor width being greater than the slot width, the first tine being movable generally toward the second tine to move the rail anchor to a moved, stressed position and the first tine being movable generally away from the second tine to move the rail anchor from the moved, stressed position to a normal, unstressed position, the first ends of the first and the second tines being disposable in the anchor slot between the first side of the first seat plate and the first side of the second seat plate and the rail anchor being movable in an insertion direction generally from the second ends of the first and the second seat plates generally toward the first ends of the first and the second seat plates while in the moved, stressed position of the rail anchor, and the rail anchor being movable from the moved, stressed position to the normal, unstressed position wherein the rail anchor curved bearing surface is disposed adjacent the rail seat curved bearing surface, the rail anchor curved bearing surface comprising a first seat surface formed on the first side of the first tine and a second seat surface formed on the second side of the second tine, the first seat surface on the first tine engaging the first rail seat curved bearing surface on the first rail seat plate and the second seat surface on the second tine engaging the second rail seat curved bearing surface on the second seat plate in the assembled position of the rail anchor and the rail seat assembly.

9. A rail-tie fastening assembly for connecting a rail flange with an upper surface, a lower surface, a first side and a second side to a tie having an upper surface, comprising:

a rail seat plate having a first end, a second end, a first side, and a second side, a distance between the first side and the second side of the rail seat plate forming an anchor slot, the rail seat plate being connectable to the upper surface of the tie and having a seat hook connected to the first end thereof with the seat hook being adapted to extend a distance over a portion of the upper surface of the rail flange generally near the first side of the rail flange, a first seat surface being formed on the first end of the rail seat plate near the first side of the rail seat plate and a second seat surface being formed on the first end of the rail seat plate near the second side of the rail seat plate with the first and second seat surfaces on the rail seat plate being formed on a first radius and forming parts of a rail seat curved bearing surface;

a rail anchor, the rail anchor being operatively associated with the rail seat plate, an anchor hook assembly being formed on a portion of the rail anchor with a portion of the rail anchor hook assembly being adapted to extend over a portion of the upper surface of the rail flange generally near the second side of the rail flange, a portion of the rail anchor being formed on a second radius to provide a rail anchor curved bearing surface, the rail anchor curved bearing surface being disposed adjacent the rail seat curved bearing surface in an assembled position of the rail anchor and the rail seat plate, the first radius being larger than the second radius and the rail anchor curved bearing surface rocking or rolling on the rail seat curved bearing surface for reducing friction therebetween, the rail anchor further comprising:

a first tine having a first end, a second end, a first side, a second side, an upper surface and a lower surface, a first seat surface being formed on the second side of the first tine with the first seat surface forming a portion of the rail anchor curved bearing surface; and a second tine having a first end, a second end, a first side, a second side, an upper surface and a lower surface, a second seat surface being formed on the second side of the second tine with the second seat surface forming a portion of the rail anchor curved bearing surface, a distance between the second side of the first tine and the second side of the second tine forming an anchor width with the slot width being greater than the anchor width; and means for connecting the second end of the first tine to the second end of the second tine, the first tine being movable generally away from the second tine for moving the rail anchor from a normal, unstressed position to a moved, stressed position and the first tine being movable generally toward the second tine for moving the rail anchor from the moved, stressed position to the normal, unstressed position, the first tine being movable generally over the first side of the rail seat plate in a direction from the second end toward the first end of the rail seat plate and the second tine being movable generally over the second side of the rail seat plate in a direction generally from the second end toward the first end of the rail seat plate for moving the rail anchor toward an assembled position with the rail seat plate, the rail anchor being movable from the moved, stressed position to the normal, unstressed position in the assembled position of the rail anchor and the rail seat plate with the first rail anchor curved bearing surface formed on the first tine engaging the first seat surface formed on the first end of the rail seat plate near the first side of the rail seat plate and the second rail anchor curved bearing surface on the second tine being engageable with the second seat surface formed on the first end of the rail seat plate near the second side of the rail seat plate in the assembled position of the rail anchor and the rail seat plate.

* * * * *

Disclaimer and Dedication 5,288,016—S. Hudson Owen, Marshfield, Wis. RAIL-TIE FASTENING ASSEMBLY WITH ROCKING BEARING SENT. Patent dated Feb. 22, 1994. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*